United States Patent [19]

Stout

[11] 4,299,546

[45] Nov. 10, 1981

[54] VANE CONTROL BEARING ASSEMBLY

[76] Inventor: Robert L. Stout, 5860 Charlesgate Rd., Dayton, Ohio 45424

[21] Appl. No.: 99,786

[22] Filed: Dec. 3, 1979

[51] Int. Cl.[3] ..... F01C 11/00; F01C 21/00

[52] U.S. Cl. ..... 418/13; 418/212; 418/254; 418/263; 418/264

[58] Field of Search ..... 418/13, 212, 213, 254, 418/263, 264

[56] References Cited

U.S. PATENT DOCUMENTS

| | | | |
|---|---|---|---|
| 478,271 | 7/1892 | Beard | 418/212 |
| 777,968 | 12/1904 | Mackin | 418/212 |
| 991,314 | 5/1911 | Humphreys | 418/254 |
| 3,114,324 | 12/1963 | Baker, Jr. | 418/264 |
| 3,904,327 | 9/1975 | Edwards et al. | 418/264 |

*Primary Examiner*—John J. Vrablik

*Attorney, Agent, or Firm*—Donald J. Singer; Richard J. Killoren

[57] ABSTRACT

A rotary vane gas cycle apparatus having radial slots in the vanes and with cam bearings supported in the slots. A camtrack member is supported by the rotary vane gas cycle apparatus housing and fits into the slots in the vanes and rotor to control the movement of the vanes during rotation of the rotor assembly within the chamber in the housing. Springs are provided in the rotor slots to support the weight of the vanes when the rotor assembly is not rotating.

1 Claim, 4 Drawing Figures

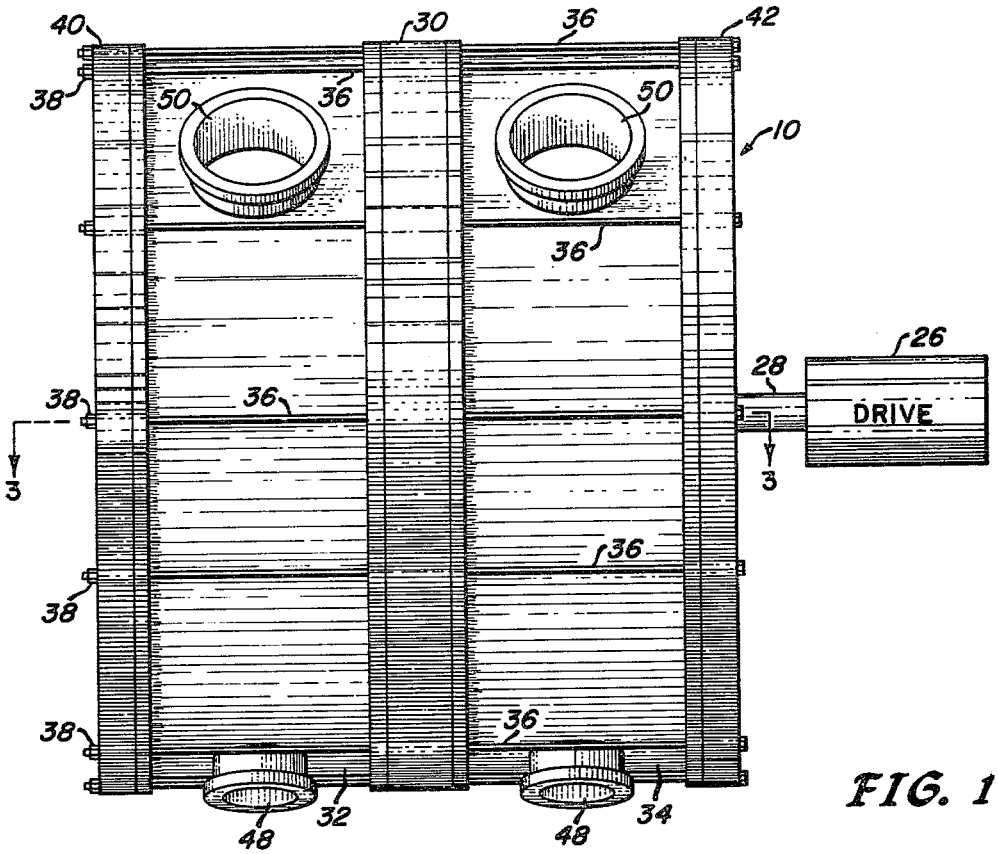
FIG. 1
FIG. 2
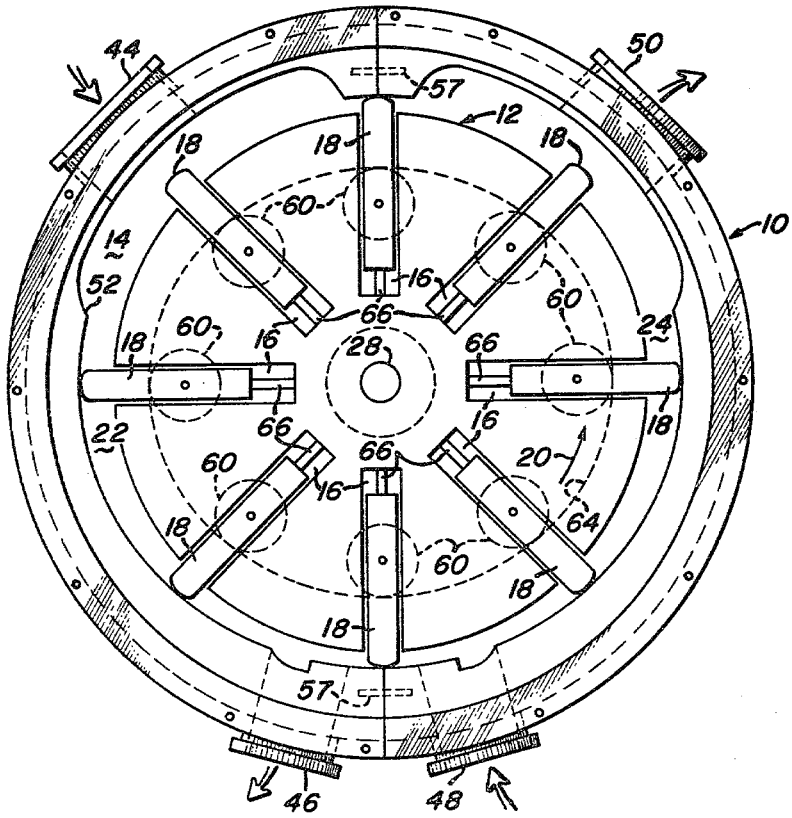

VANE CONTROL BEARING ASSEMBLY

RIGHTS OF THE GOVERNMENT

The invention described herein may be manufactured and used by or for the Government of the United States for all governmental purposes without the payment of any royalty.

BACKGROUND OF THE INVENTION

This invention relates to a vane bearing assembly for a rotary vane gas cycle apparatus. The patents to Edwards, U.S. Pat. Nos. 3,967,466 and 3,977,852, show conventional rotary vane gas cycle apparatus.

In conventional cam controlled rotary vane gas cycle apparatus, camtracks are provided at the two axial ends of the rotor. Vane bearings are provided at the two axial ends of the vanes. The vane bearings engage the camtracks to control the radial movement of the vanes in the rotor slots.

BRIEF SUMMARY OF THE INVENTION

According to this invention, a radial slot is provided in each of the vanes to receive camtrack bearings. A split cam is secured between two sections of the rotary gas cycle apparatus housing. The cam is split so that it can be inserted into the radial vane slots during assembly and acts to control the radial movement of the vanes in the rotor slots.

IN THE DRAWINGS

FIG. 1 is a partially schematic plan view of a rotary vane gas cycle apparatus according to the invention.

FIG. 2 is a left end view of the device of FIG. 1 with the end plate cover removed.

DETAILED DESCRIPTION OF THE INVENTION

Figure 3:
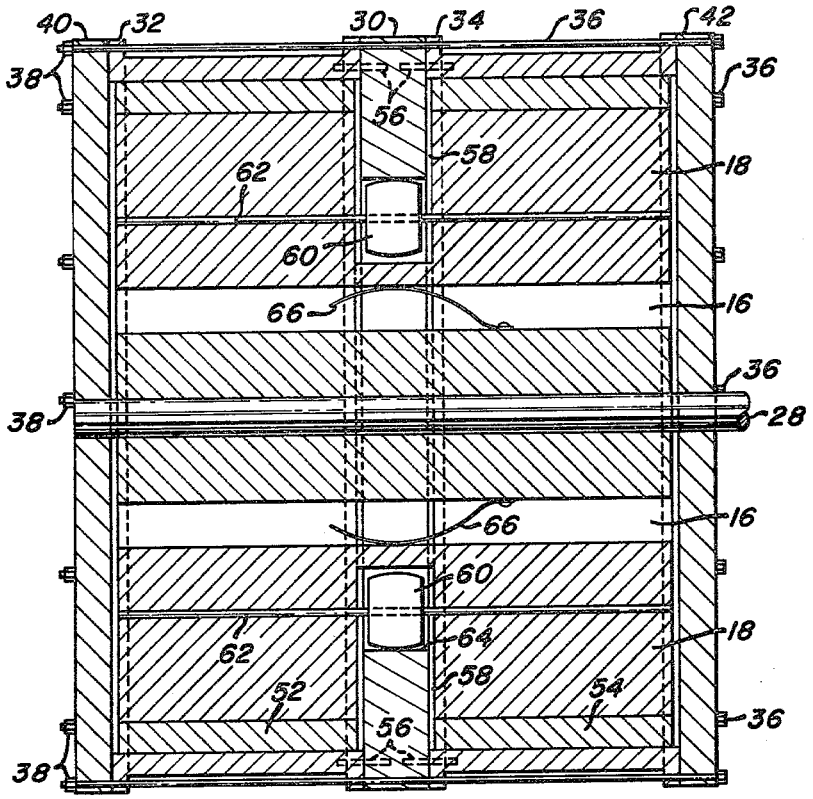
FIG. 3 is a partially schematic sectional view of the device of FIG. 1 along the line 3—3.

Reference is now made to FIG. 1 of the drawing which shows a rotary vane gas cycle apparatus 10 including a rotor assembly 12 within a chamber 14, as shown in FIG. 2. The rotor assembly 12 includes a plurality of radial slots 16 with vanes 18 being positioned within the slots 16 as in a conventional rotary vane gas cycle apparatus. With a rotation as indicated at 20, the portion of chamber 14, indicated at 22, will act as a compressor and the portion of chamber 14, indicated at 24, will act as an expander. The rotor assembly is driven in a conventional manner by drive 26 through shaft 28.

A two part vane control camtrack member 30 is secured between a pair of two part housing members 32 and 34. Bolts 36 and nuts 38 secure the housing and camtrack assembly together with end plate members 40 and 42. The camtrack member 30 divides the chamber 14 into two independent rotary vane gas cycle apparatus sections each including a compressor, an expander with compressor and expander inlets and outlets.

Each of the housing members 32 and 34 includes a compressor inlet 44, a compressor outlet 46, an expander inlet 48 and an expander outlet 50. A pair of two part stator wall members 52 and 54 fit inside the housing members 32 and 34 and are shaped to provide the desired shape for chamber 14. The stator members are positioned with respect to the camtrack member 30 by alignment pins 56. Axial alignment pins 57 are also provided in the stator members. In some applications the stator members could be made integral with the housing members. Also the housing members 32 and 34 could be made as a unitary structure with the camtrack member being positioned within the housing between the stator members. Seals, not shown, would be provided between housing, camtrack and stator parts.

Figure 4:
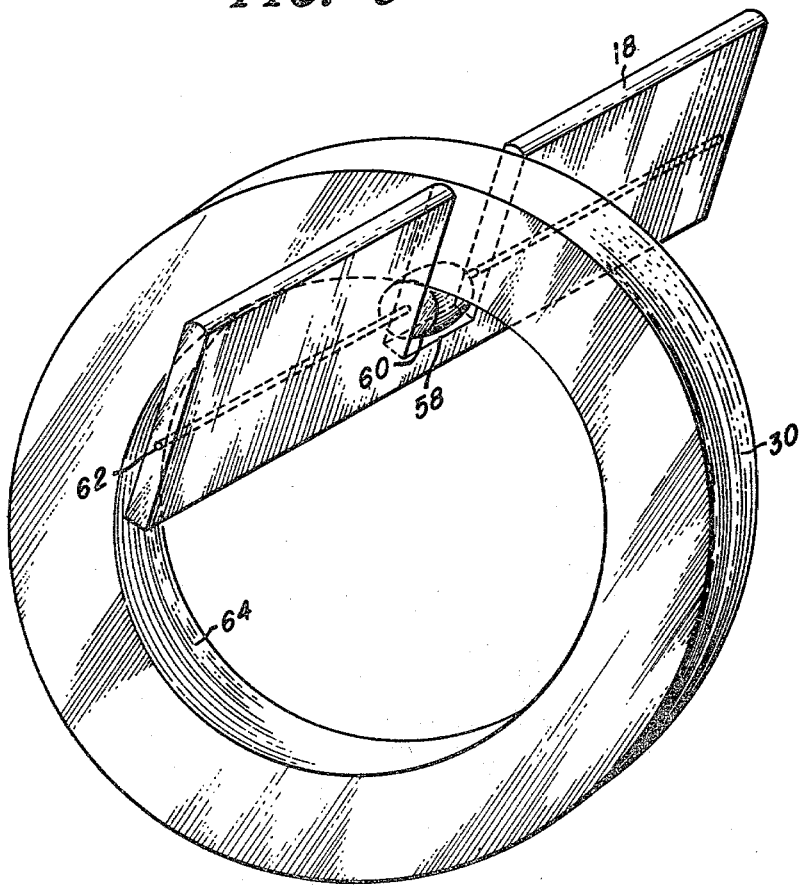
FIG. 4 is a partially schematic isometric view of the vane control camtrack of the device of FIG. 1 with one rotor vane shown.

Each of the vanes 18 includes a radial slot 58, as shown in FIGS. 3 and 4. A camtrack bearing 60 is positioned in the slot in each of the vanes. The bearings are secured to the vanes by any known means, such as by a shaft 62 which extends through each vane. The bearings 60 engage the surface 64 of the camtrack member 30 which controls the radial movement of the vanes 18 in slots 16.

Either the camtrack or the vanes must be made as two part members to permit assembly of the camtrack in the vane slots. In the device shown, the camtrack is shown as a two part member. The stator sections and housing sections are also shown as two part members; however, apparatus of different design than that shown could be constructed with only either the camtrack or the vane members made as two part members.

Since there is no inside cam member provided for bearings 60, the vanes on the top of the apparatus would drop the bottom of the slots when the rotor assembly stops. This might cause damage to the vanes and camtrack member when the apparatus is started. Springs 66, sufficient to support the weight of the vanes are provided in the slot to bear against the bottom of the vanes to hold the vanes against the camtrack member when the rotor assembly stops. If the device is operated with the shaft 28 in a vertical position, springs 66 would not be needed.

In the operation of the device, the rotary vane gas cycle apparatus would be operated in a conventional manner with the camtrack bearings 60 being held in contact with the cam surface 64 by centrifugal force as the rotor assembly is rotated in chamber 14 by drive 26. The cam surface 64 controls the movement of the vanes in slots 16. The device can be operated either as a two stage rotary vane gas cycle device or as two rotary vane gas cycle devices operated in parallel.

While a single radial slot has been shown in each of the vanes more than one slot could be provided in each vane with camtrack bearings in each of the slots to accommodate more than one camtrack member and with compressor and expander inlets and outlets being provided in each section of the rotary vane gas cycle device housing. Also though not shown passages could be provided in the camtrack members between the sections, if desired, for some applications, for example, to equalize the pressure when two or more sections are operated in parallel. The device could also be used with vane guides, as described in my copending application, "Vane Guides for Rotary Vane Gas Cycle Apparatus", Ser. No. 06/089,792, filed Oct. 31, 1979, now U.S. Pat. No. 4,261,184.

There is thus provided a rotary vane gas cycle apparatus which can have a smaller size with reduced weight and which is less costly to manufacture that prior devices.

I claim:

1. A rotary vane gas cycle apparatus comprising: a housing including two axially displaced housing sections; a stator in each of said housing sections and defining a compressor and expander chamber within each of said housing sections; a compressor and expander within each of said housing sections and being driven by a common shaft; said compressor and expander including a rotor assembly within said chambers; said rotor assembly having a plurality of vane members forming a plurality of cells which change in volume as the shaft rotates; said rotor assembly including a plurality of radial slots for slideably receiving the vane members; a radial slot in each of the vane members; a camtrack bearing supported in the slot in each of the vane members; a camtrack member, secured between said housing sections, and being adapted to engage the camtrack bearings, for controlling the movement of the vane members in the rotor slots; spring means, engaging the vane members, for biasing the vane members radially outward in the rotor slots; said housing including compressor and expander inlets and outlets in each of said housing sections.

* * * * *